US006681872B2

(12) United States Patent
Radtke et al.

(10) Patent No.: US 6,681,872 B2
(45) Date of Patent: Jan. 27, 2004

(54) IN SITU REACTOR

(75) Inventors: Corey William Radtke, Lubbock, TX (US); David Bradley Blackwelder, Blackfoot, ID (US)

(73) Assignee: Bechtel BWXT Idaho, LLC, Idaho Falls, ID (US)

( * ) Notice: Subject to any disclaimer, the term of this patent is extended or adjusted under 35 U.S.C. 154(b) by 0 days.

(21) Appl. No.: 10/163,670

(22) Filed: Jun. 5, 2002

(65) Prior Publication Data

US 2003/0226690 A1 Dec. 11, 2003

(51) Int. Cl.[7] ..... E21B 49/02; E21B 25/00; G01N 1/08

(52) U.S. Cl. ..... 175/20; 175/58; 175/248; 175/310; 73/864.44

(58) Field of Search ..... 175/20, 403, 405, 175/310, 58, 244, 248; 73/864.44, 864.45

(56) References Cited

U.S. PATENT DOCUMENTS

| | | | | | |
|---|---|---|---|---|---|
| 1,896,703 | A | * | 2/1933 | Dean | 175/249 |
| 3,047,081 | A | * | 7/1962 | Pitcher | 175/239 |
| 3,447,615 | A | * | 6/1969 | Schick | 175/17 |
| 3,497,018 | A | * | 2/1970 | Shultz et al. | 175/6 |
| 3,530,933 | A | * | 9/1970 | Whitten | 166/100 |
| 3,696,873 | A | * | 10/1972 | Anderson | 175/20 |
| 4,043,407 | A | * | 8/1977 | Wilkins | 175/50 |
| 4,081,040 | A | * | 3/1978 | Henson | 175/58 |
| 4,588,036 | A | * | 5/1986 | Desrochers et al. | 175/58 |
| 4,860,599 | A | * | 8/1989 | Griffis | 73/864.45 |
| 5,010,776 | A | * | 4/1991 | Lucero et al. | 73/863.23 |
| 5,058,688 | A | * | 10/1991 | Scott et al. | 175/20 |
| 5,101,917 | A | * | 4/1992 | Abdul et al. | 175/253 |
| 5,348,422 | A | | 9/1994 | Manchal, III et al. | |
| 5,372,208 | A | * | 12/1994 | Mefferd | 175/314 |
| 5,710,361 | A | | 1/1998 | Harrington et al. | |
| 5,813,461 | A | | 9/1998 | Theisen | |
| 5,931,237 | A | * | 8/1999 | Henke et al. | 175/50 |
| 5,979,569 | A | * | 11/1999 | Heller | 175/20 |
| 6,000,481 | A | * | 12/1999 | Heller et al. | 175/20 |
| 6,203,703 | B1 | | 3/2001 | Yerushaimi et al. | |
| 6,305,482 | B1 | * | 10/2001 | Aumann et al. | 175/58 |

FOREIGN PATENT DOCUMENTS

| | | | | |
|---|---|---|---|---|
| GB | 2276897 | A | * 10/1994 | E21B/25/04 |

OTHER PUBLICATIONS

"Ground Water Clean–up Using In–Situ Bioremediation," Geo/Environmental Associates, Inc., 2000. Pp. 1–5. http://www.geo.com/special%20Projects/In–Situ%20Bioreactor.htm Printed Sep. 24, 2001.

"In–Situ Microbial Filters," LLNL Bioremediation Technologies, Jun. 18, 2001. Pp. 1–5 Wysuwyg://202/http://www.llnl.gov/ees/aet/biofilt/biofilthtml Printed Sep. 24, 2001.

* cited by examiner

*Primary Examiner*—David Bagnell
*Assistant Examiner*—T. Shane Bomar
(74) *Attorney, Agent, or Firm*—Wells St. John Roberts Gregory & Matkin

(57) ABSTRACT

An in situ reactor for use in a geological strata, is described and which includes a liner defining a centrally disposed passageway and which is placed in a borehole formed in the geological strata; and a sampling conduit is received within the passageway defined by the liner and which receives a geological specimen which is derived from the geological strata, and wherein the sampling conduit is in fluid communication with the passageway defined by the liner.

16 Claims, 4 Drawing Sheets

IN SITU REACTOR

CONTRACTUAL ORIGIN OF THE INVENTION

The United States Government has rights in the this invention pursuant to Contract No. DE-AC07-99ID13727 between the United Department of Energy and Bechtel BWXT Idaho, LLC.

TECHNICAL FIELD

The present invention relates to a In situ reactor for use in geological strata such as various subsurface soils, sediment, or other matrix, and more specifically to an In situ reactor which is useful to evaluate environmental conditions required to remediate potential hazardous conditions which may occur in the soil and groundwater.

BACKGROUND OF THE INVENTION

The costs associated with testing for various contaminants in soil and aquifers are well known. Currently, In situ assessment technology provides data on usually one treatment with respect to a contaminant. Further, replication of earlier testing is usually done at exorbitant monetary costs. Still further, the impact of current testing techniques to detect, for example, groundwater contamination has other environmental impacts on a given area and there is usually no guarantee regarding the accuracy of the resulting data. Routinely, investigators and engineers use rather costly laboratory tests to evaluate the efficacy of future and on-going remedial treatments.

While laboratory tests are more extensively used, and are generally considered more accurate, these studies are also more expensive to perform and may produce ambiguous or inaccurate data because of the consequences associated with excessive soil disruption. Still further, these same laboratory tests provide no assurances that same process will be found applicable in actual field conditions. For example, experiments that are run in a traditional manner on soil specimens or water extracted from soil specimens are not run traditionally under real time. Therefore, the results are sometimes questionable. Still further, in investigating various soil contamination, it is sometimes advisable to test proposed remediation while the soil specimen remains in hydraulic contact with the underlying subsurface aquifer. Yet further, there is no convenient method presently available whereby the aquifer may be investigated and/or modeled and not merely the groundwater which is sampled from same.

In addition to the shortcomings noted above, the prior art techniques do not allow soil specimens, for example, to maintain their biofilms and soil structures in an intact state while they are being tested for various contamination. In this regard, traditional techniques (removing the soil for laboratory testing) have introduced reactive sites to the soil and which has been disturbed in order to remove it for laboratory testing. Still further, the techniques for testing for groundwater and other soil contamination may have resulted in disturbing of the various microbial communities found in the soil column. Therefore the results of such testing have been highly questionable when microbial communities are relevant to the remediation treatment being considered for a given geological strata.

These and other shortcomings are addressed by means by an In situ reactor which will be discussed in further detail in the paragraphs which follow.

SUMMARY OF THE INVENTION

Therefore, one aspect of the present invention is to provide an In situ reactor for use in a geological strata and which includes a liner defining a centrally disposed passageway and which is placed in a borehole formed in the geological strata; and a sampling conduit received within the passageway defined by the liner and which receives a geological specimen which is derived from the geological strata, and wherein the sampling conduit is in fluid communication with the passageway defined by the liner.

Still another aspect of the present invention relates to an In situ reactor for use in a geological strata, and which includes a fluid coupler borne by the liner and which is disposed in fluid communication with both the liner and the sampling conduit and wherein the sampling conduit has a proximal and a distal end, and wherein the fluid coupler sealably mates to both the liner and the proximal of the sampling conduit, and wherein an aperture is formed in the sampling conduit, near the distal end thereof, and which provides fluid flowing communication between the sampling conduit and the passageway defined by the liner, and wherein the geological strata has a grade and wherein the fluid coupler includes first and second passageways which respectively communicate with the passageway defined by the liner, and the sampling conduit, and wherein the first and second passageways are coupled in fluid flowing relation to a location above grade.

Still another aspect of the present invention relates to an In situ reactor for use in geological strata, and which includes a liner having a main body, and which defines a passageway and wherein the liner is placed within a borehole which extends from a location at grade, into the geological strata, and wherein the liner is moveable along the borehole; a sampling conduit received within the passageway, and which defines a reactor space which is operable to receive a geological specimen which is derived from the geological strata, and wherein the reactor space is in fluid communication with the passageway defined by the liner; and a fluid coupler is borne by the liner, and which is disposed in fluid flowing communication with the passageway defined by the liner, and the reactor space, and wherein the fluid coupler is coupled in fluid flowing communication to a location above grade.

Still another aspect of the present invention relates to an In situ reactor, and wherein a force is applied from a location above grade and which is applied to the fluid coupler to simultaneously urge the liner and the sampling conduit along the borehole, and into contact with the geological strata, and wherein continued force applied to the fluid coupler causes the geological specimen which is derived from the geological strata to move into the reactor space.

Still another aspect of the present invention relates to an In situ reactor wherein the force applied to the fluid coupler may include linear and rotational components.

Still another aspect of the present invention relates to an In Situ reactor for use in geological strata, and which includes a cylindrically shaped liner having a main body with opposite proximal and distal ends, an outside facing surface which defines an outside diametral dimension, and an inside facing surface which defines a substantially cylindrically shaped passageway having a diametral dimension, and which extends between the proximal and distal ends, and wherein the liner is placed within a borehole having a diametral dimension which is greater than the outside diametral dimension of the main body, and which is formed in the geological strata and which extends from a location substantially at grade, and into the geological strata, and wherein the liner is moveable along the borehole; a geological strata engaging member borne by the distal end of the cylindrically shaped liner, and wherein the geological strata engaging member has a main body with a proximal end which nests within the passageway at the distal end of the liner, and a distal end which engages the geological strata; a sampling conduit having a substantially cylindrically shaped main body with opposite proximal and distal ends, and an outside facing surface which defines an outside diametral dimension which is less than diametral dimension of the passageway defined by the liner, and an inside facing surface which defines a reactor space which extends between the proximal and distal ends of the main body of the sampling conduit, and wherein an aperture is formed in the main body at a location near the distal end of the main body, and which establishes fluid flowing communication between the passageway defined by the liner and the reactor space, and wherein the main body of the sampling conduit is substantially concentrically located within the passageway defined by the liner, and wherein the distal end of the main body of the sampling conduit is juxtaposed relative to the proximal end of the geological strata engaging member; a fluid coupler mounted on the proximal end of the liner and which sealably mates to the proximal end of the sampling conduit, and wherein the fluid coupler defines a first fluid passageway which is coupled in fluid flowing relation relative to the passageway defined by the liner, and a second fluid passageway which is coupled in fluid flowing relation relative to the reactor space, and wherein the first and second fluid passageways are individually coupled in fluid flowing relation relative to a location above grade; and a force application assembly is provided and which is mounted on the fluid coupler, and which applies force to the fluid coupler to urge the liner, and the sampling conduit to simultaneously move along the borehole, and into contact with the geological strata, and wherein the continued application of force causes a geological specimen which is derived from the geological strata to move into the reactor space.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
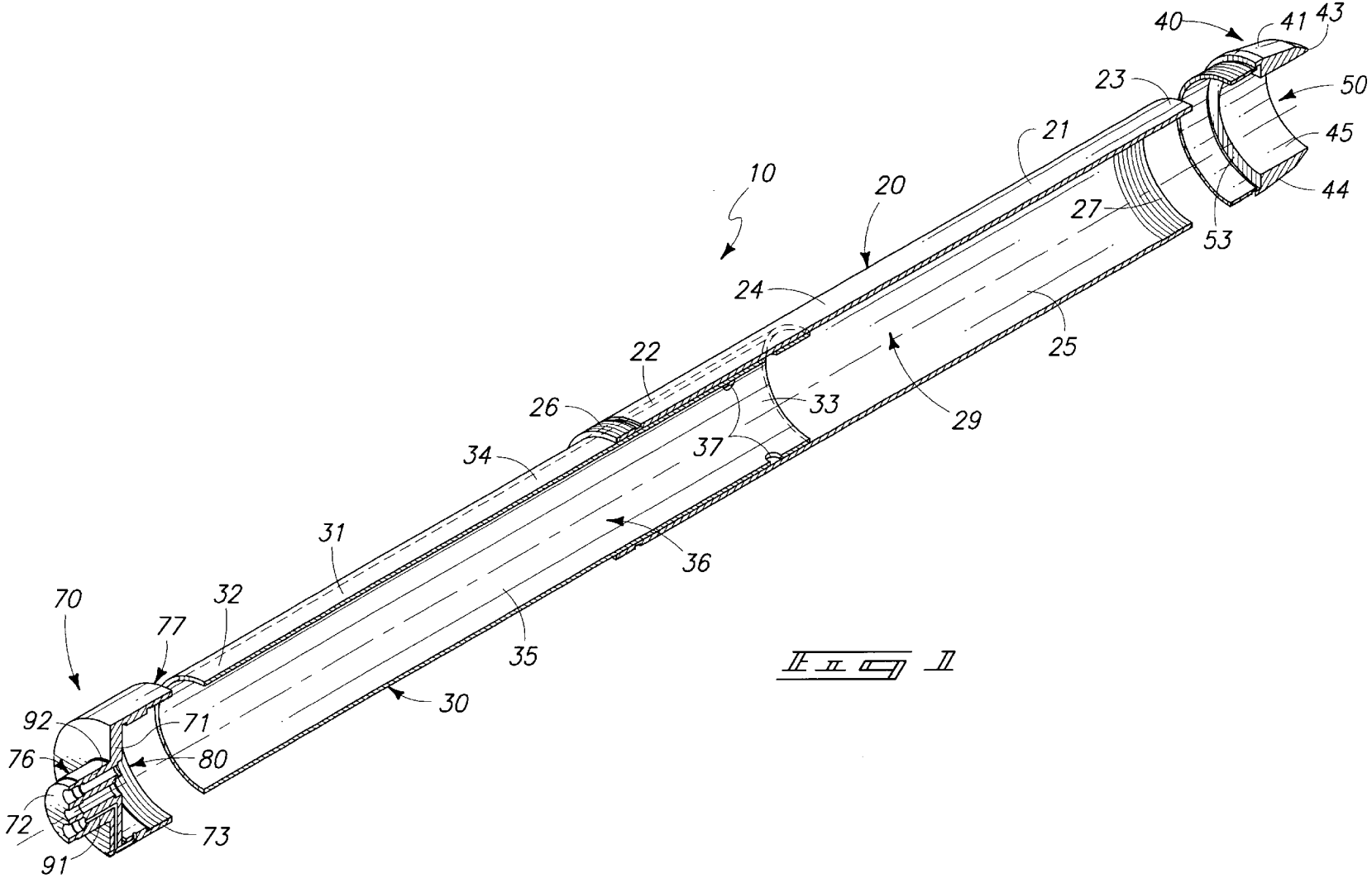
FIG. 1 is an exploded, perspective, longitudinal vertical sectional view of an In situ reactor of the present invention.
Figure 2:
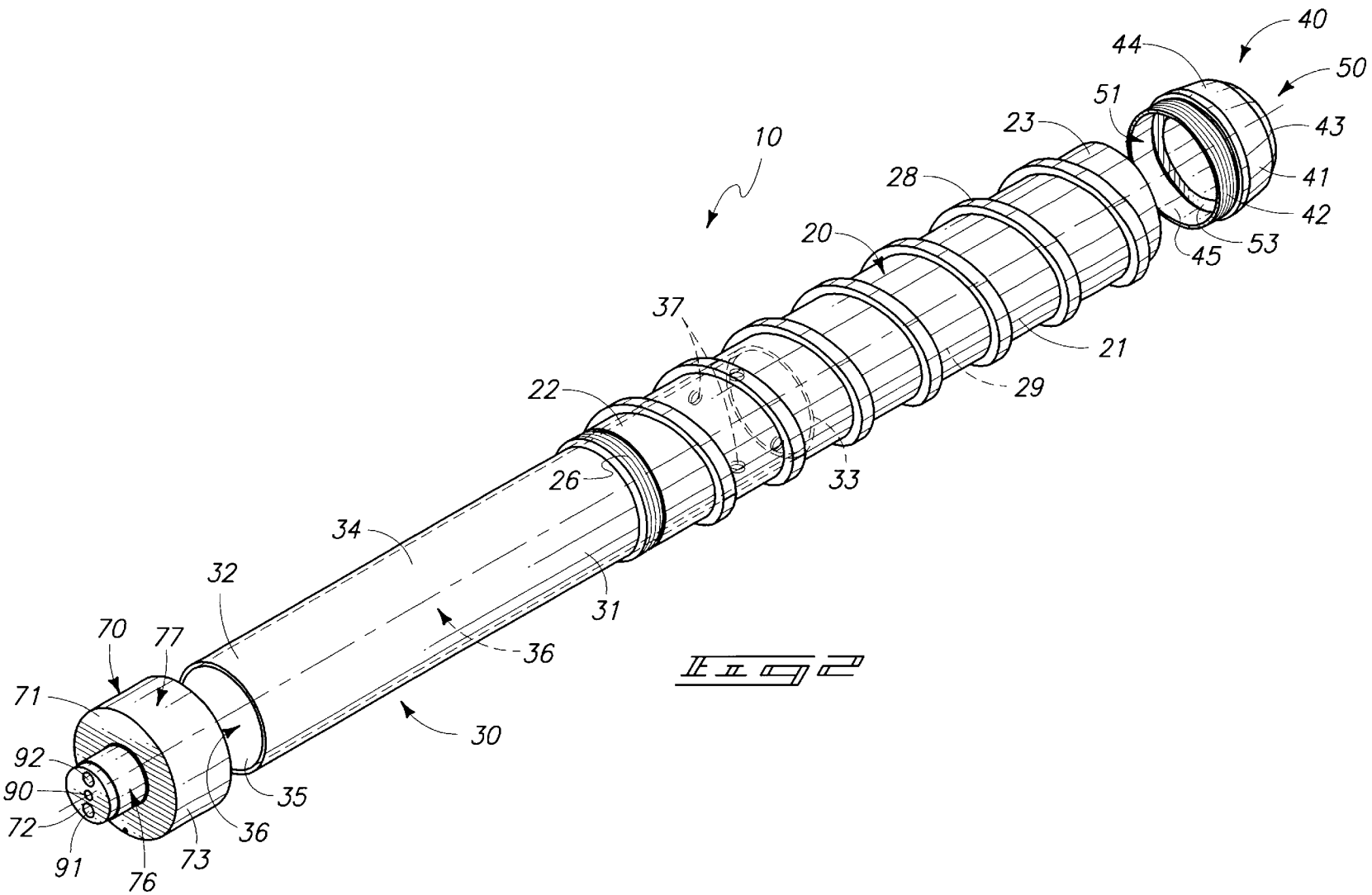
FIG. 2 is an exploded, perspective view of a second form of the present invention with some underlying surfaces shown in phantom lines.
Figure 8:
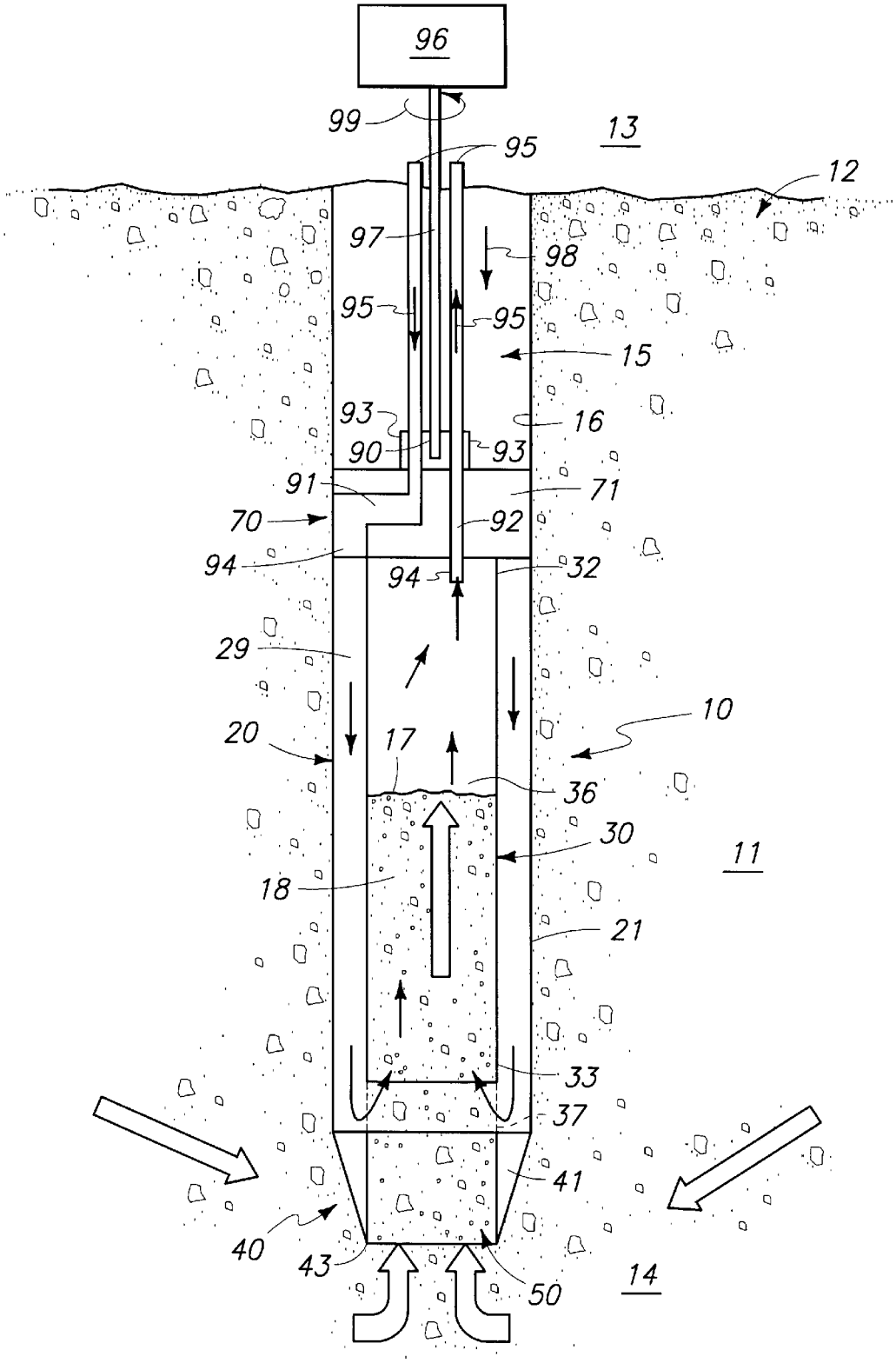
FIG. 8 is a somewhat simplified graphic depiction of the present invention employed at a location, in a borehole, below grade.

An In situ reactor which incorporates the teachings of the present invention is best seen by reference to the numeral 10 in FIGS. 1, 2, and 8, respectively. As discussed above, the present invention finds usefulness when employed in geological strata 11 such as various subsurface soils, sediment or other matrix for use in various testing regimens to facilitate remediation of existing soil and groundwater contamination. As seen most clearly by reference to FIG. 8, the geological strata 11 has a grade 12. The apparatus 10 is deployed and operated from a position at or above grade 13 to a position below grade 14 by means of a borehole 15 which is formed by traditional means. The borehole is defined by a wall 16, and further has a bottom surface which is generally indicated by the numeral 17. As seen in FIG. 8 the In situ reactor 10 is operable to receive a geological specimen 18 which is derived from the geological strata 11 and received internally of the In situ reactor. This feature will be discussed in further detail hereinafter.

Figure 7:
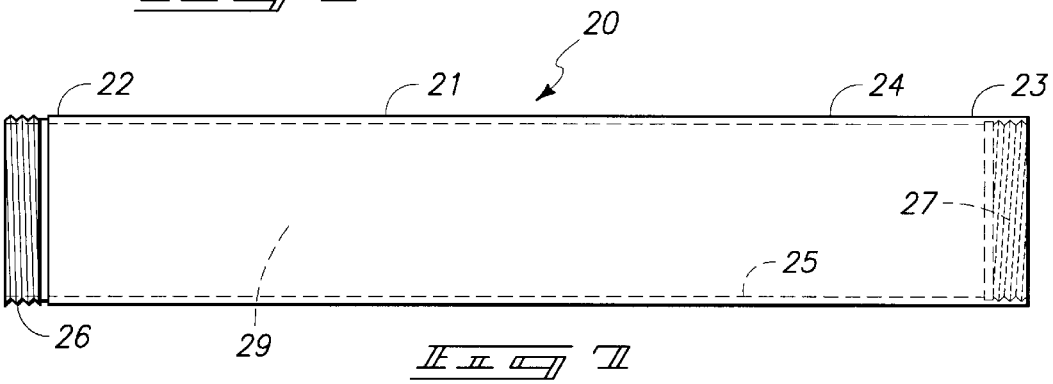
FIG. 7 is a side elevation view of a liner which finds usefulness in the present invention. Some underlying surfaces are shown in phantom lines.

The apparatus 10 includes a liner which is generally indicated by the numeral 20 as seen in FIGS. 1, 2, 7 and 8, respectively. As shown therein, the liner 20 has a substantially cylindrically shaped main body 21 having a proximal end 22 and an opposite distal end 23. Still further, the main body 21 is defined by outside facing surface 24 which has a diametral dimension which is less than the diametral dimension of the borehole 15, and further has an opposite inside facing surface 25 having a predetermined diametral dimension. As seen in FIGS. 1 and 7, for example, it will be seen that a first series of screw threads 26 are formed in the outside facing surface 24, at the proximal end 22 of the main body 21. Still further, a second series of screw threads 27 are formed in the inside facing surface 25 at the distal end 23. As seen, by comparing FIGS. 1 and 2, in the second form of the invention as shown in FIG. 2, a geological strata engaging thread 28 is provided. The geological strata engaging thread 28 is borne by, or otherwise made integral with the outside facing surface 24 of the liner 20. It should be understood in this form of the invention that this geological strata engaging thread 28 permits the liner 20 to be advanced along the borehole 15 by imparting rotation to the liner in a given direction as will be discussed in greater detail hereinafter. As seen by reference to FIGS. 1 and 7, the inside facing surface 25 defines a passageway which is generally designated by the numeral 29.

As seen most clearly by reference to FIGS. 1, 2, and 8, the apparatus 10 includes a sampling conduit which is generally indicated by the numeral 30. The sampling conduit has a substantially cylindrically shaped main body 31 which is substantially concentrically located within the passageway 29 which is defined by the liner 20. As seen in FIGS. 1 and 2, the main body 31 has a proximal end 32, and an opposite distal end 33. The main body 31 has a length dimension which is less than the length dimension of the main body of the liner 20. Still further, the main body 31 has an outside facing surface 34 which has a diametral dimension which is less than the inside diametral dimension as defined by the inside facing surface 25 of the liner 20. As will be recognized, this dimensional relationship allows the sampling conduit 30 to be telescopingly received or otherwise nested within the passageway 29. As seen in FIG. 8, this physical, relationship provides a gap or space between the outside surface 34 and the inside facing surface 25. The passageway 29, thereby becomes substantially annularly shaped. Still further, the main body 31 has an inside facing surface 35 which defines a reactor space 36 which extends between the proximal and distal ends 32 and 33 thereof. As will be seen by reference to FIGS. 1, 2 and 8, at least one aperture 37 is formed near the distal end 33 of the main body 31 thereby facilitating fluid flowing communication between the passageway 29 and the reactor space 36. As seen in FIG. 8, the geological specimen 18 is received within the reactor space 36.

Figure 3:
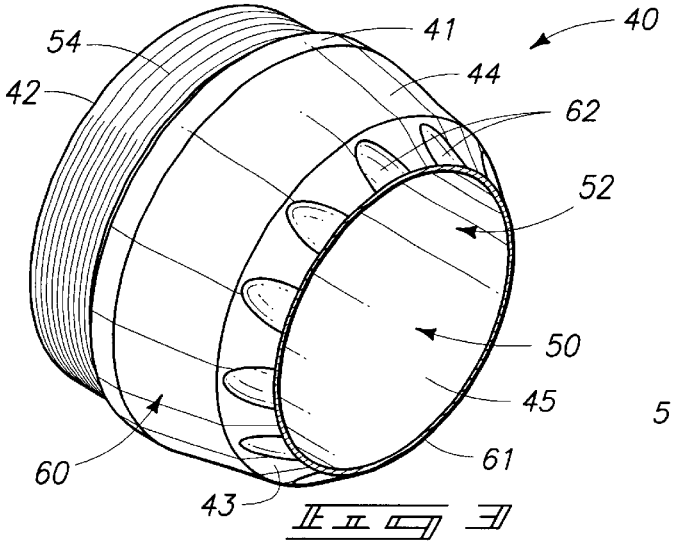
FIG. 3 is a perspective, end view of a geological strata engaging member employed with the present invention.
Figure 5:
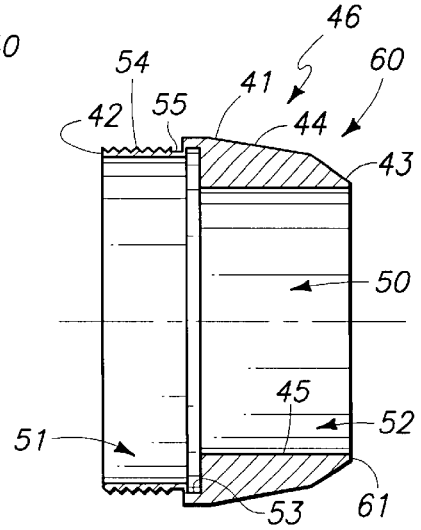
FIG. 5 is a longitudinal, vertical, sectional view of a geological strata engaging member employed with the present invention.
Figure 4:
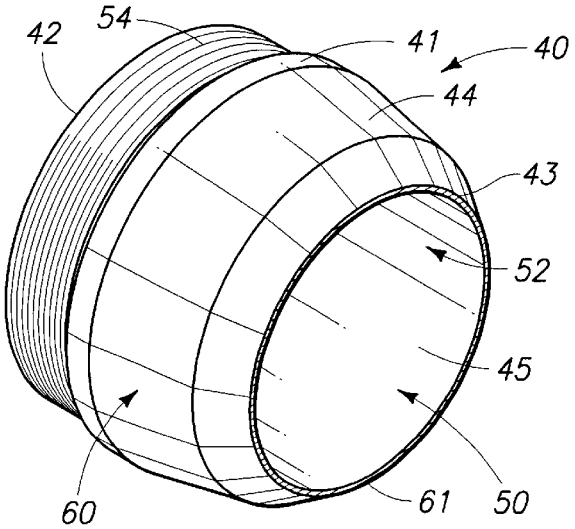
FIG. 4 is a perspective, end view of a second form of a geological strata engaging member employed with the present invention.

Referring now to FIGS. 1, 2, 3, 4, and 5, for example, the In situ reactor 10 of the present invention includes a geological strata engaging member which is generally indicated by the numeral 40. This member 40 is mounted on the distal end 23 of the liner 20 in a fashion which will be discussed below. As seen by FIG. 8, and by further reference to FIGS. 1 and 2, the geological strata engaging member 40 has a main body 41 with a proximal end 42 and an opposite, distal end 43. Still further, the main body 41 is defined by an outside facing surface 44 and an opposite outside facing surface 45 which defines a passageway generally designated by the numeral 50. As seen in the longitudinal, sectional view of FIG. 5, it will be understood that the passageway 50 includes a first portion 51 which is located near the proximal end 42 thereof. The first portion 51 has a first inside diametral dimension defined by the inside facing surface 45. Still further, the passageway 50 has a second, portion 52 which is concentrically located relative to the first portion 51, and which has a second diametral dimension which is less than the first portion. An annularly shaped seat 53 is defined by the inside facing surface 45 and is located between the first and second portions 51 and 52. Still further as seen in FIGS. 3, 4 and 5, a series of screw threads 54 are formed in the outside facing surface 44 at the proximal end 42. This series of threads 54 are operable to threadably mate with the series of screw threads 27 which are formed in the inside facing surface 25 at the distal end 23 of the liner 20. As will be recognized, this allows the main body of the geological strata engaging member to nest inside or otherwise be threadably mated and thus secured to the distal end 23 of the liner 20. Still further, the seat 53 mateably or otherwise engages the distal end 33 of the sampling conduit 30 when it is appropriately located in telescoping relation relative to the passageway 29. As will be recognized by a comparative study of FIGS. 5 and 8, the inside diametral dimension of the first portion 51 is greater than the outside diametral dimension as defined by the outside facing surface 34 of the sampling conduit 30. Still further, the diametral dimension of the second portion 52 is less than or equal to the diametral dimension of the reactor space 36, which is defined by the inside facing surface 35 of the sampling conduit 30. As seen in FIG. 5, for example, an o-ring seat 55 is formed in the outside facing surface 44, and is operable to receive a suitable seal which will allow the main body 44 to sealably mate with the distal end 23 of the liner 20. Yet further, it will be recognized that the outside facing surface 44 has a diminishing outside diametral dimension when measured in a direction from the proximal to the distal ends 42 and 43, respectively. As seen, this diminishing dimension appears tapering and somewhat generally frusto-conical in shape. Formed at the distal end 43 is a cutting edge which is generally indicated by the numeral 61. The cutting edge is operable to facilitate the movement of the In situ reactor through the geological strata 11 as will be discussed in greater detail hereinafter. As seen in the second form of the invention, as illustrated in FIG. 3, the cutting edge 61 takes on a scalloped appearance 62 which further facilitates the movement of the In situ reactor 10 through the geological strata 11 as will be discussed hereinafter. Further, it will be appreciated that a geological strata engaging thread (not shown) and which is similar to the structure 28 may be formed on the outside surface 44.

Figure 6:
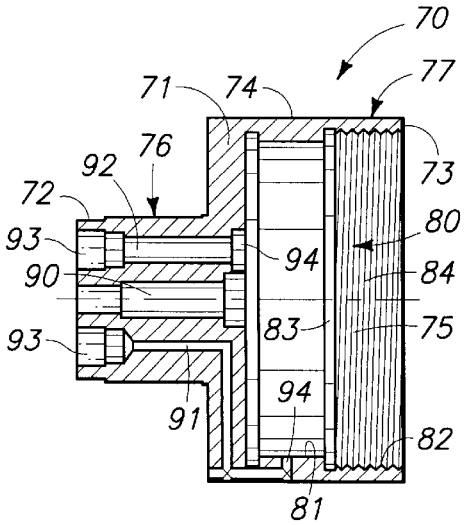
FIG. 6 is a longitudinal, vertical, sectional view of a fluid coupler which finds usefulness when employed with the present invention.

As best seen by references to FIGS. 1, 2, 6, 7 and 8, the In situ reactor of the present invention 10 includes a fluid coupler which is generally indicated by the numeral 70. The fluid coupler is releasably mounted on the proximal end 22 of the liner 20 and further sealably mates to the proximal end 32 of the sampling conduit 30. Referring to FIG. 6, the fluid coupler has a main body 71 which has opposite proximal and distal ends 72 and 73. Still further, the main body is defined by an outside facing surface 74, and an opposite inside facing surface 75. The outside facing surface 74 has first and second portions 76 and 77 which have different diametral dimensions. As shown in FIG. 6, the first portion 76 has an outside diametral dimension which is less than the outside diametral dimension of the second portion 77. The first portion 76 is substantially concentrically located relative to the main body 71. As seen in the longitudinal, vertical, sectional view of FIG. 6, a cavity 80 is defined by the inside facing surface 75 and is located generally towards the distal end 73. The cavity 80 has a first portion 81 having a first inside diametral dimension, and a second portion 82 which has a second diametral dimension which is greater than the first diametral dimension. An annular seat 83 is formed into the inside facing surface 75. The annular seat is operable to engage the proximal end 32 of the sampling conduit 30 when the In situ reactor is properly assembled. Still further, a series of threads 84 are formed in the inside facing surface 75 of the main body 71. These series of threads 84 are operable to screw threadably mate with the first series of screw threads 26 which are formed on the outside facing surface 24 of the liner 20. As seen in FIG. 6, a releasable coupling passageway 90 is formed substantially centrally relative to the first portion 76 of the main body 71. As seen in FIG. 8, force is applied by way of a push rod which is received in the passageway 90 thereby providing, in the alternative, either linear, or rotational force to the In situ reactor 10. This aspect of the invention will be discussed in greater detail hereinafter.

Referring now to FIGS. 6 and 8, the main body 71 of the fluid coupler 70 further defines first and second fluid passageways 91 and 92. Each of the fluid passageways (91 and 92) has a first end 93, and an opposite, second end 94. The first fluid passageway 91 is coupled in fluid flowing relation relative to the passageway 29, and the second fluid passageway 92 is coupled in fluid flowing relation relative to the reactor space 36 which is defined by the sampling conduit 30. As will be seen by reference to FIG. 8, each of the first and second passageways are coupled by conduits 95 in fluid flowing relation to a position at or above grade 13. Referring to FIG. 8, the invention 10 includes a force application assembly which is shown generally by the numeral 96, and which applies force to the fluid coupler 70 by means of a push rod or member 97 which releasably mates with the coupling passageway 90. As will be recognized, the force application assembly is operable to apply linear, rotational, or/combinations of linear and rotational forces to the In situ reactor 10 to cause the In situ reactor to be moved along or advanced in the borehole 15 and into contact with the geological strata 17. Still further, upon further application of both either linear, rotational or both forces, the geological strata engaging member 40 is urged into the bottom 17 of the borehole 15, thus resulting in the formation of a geological specimen 18 which moves into the reactor space. This is illustrated in FIG. 8.

As will be seen, fluids of various types can be added by way of the first and second passageways 91 and 92 in order to perform various experiments on the geological specimen 18 while the geological specimen remains in hydraulic contact with the surrounding geological strata 11. As illustrated, fluid can be added to the In situ reactor from a location above grade 13, by way of the first passageway 91 and then withdrawn by way of the second passageway 92 to the same location above grade. In the alternative, fluid may be added by way of the second passageway 92 and withdrawn by way of the first passageway depending upon the tests that need to be performed.

Referring now to FIG. 2, in order to avoid compaction of the soil or the geological strata 11 and to allow for suitable tests to be run on the geological specimen 18, rotational force may be applied by way of the force application assembly 96 to the In situ reactor, as illustrated in FIG. 2. This rotational force causes the geological strata engaging thread 28 to forcibly engage the sidewall 16 of the borehole 15 and to advance the In situ reactor 10 to an appropriate depth into the geological strata 11.

OPERATION

The operation of the described embodiments of the present invention are believed to be readily apparent and are briefly summarized at this point. As seen in the drawings, an In situ reactor 10 for use in geological strata 11 comprises a liner 20 defining a centrally disposed passageway 29 and which is placed in a borehole 15 formed in the geological strata 11 and a sampling conduit 30 is provided and which is received within the passageway 29 defined by the liner 20 and which receives a geological specimen 18 which is derived from the geological strata 11, and wherein the sampling conduit 30 is disposed in fluid communication with the passageway 29 defined by the liner 20. As noted above, the In situ reactor 10 includes a geological strata engaging member 40 which is mounted on the distal end 23 of the liner and which defines a passageway 50 which communicates with the sampling conduit 30, and more specifically the reactor space 36 thereof.

The In situ reactor 10 further has a fluid coupler 70 which is borne by the liner 20 and which is disposed in fluid communication with both the liner 20 and the sampling conduit 30. As earlier noted, a force application assembly 96 is provided and which is operable to provide linear rotational or a combination of linear and rotational force to the In situ reactor 10 to cause it to move or be advanced along the borehole 15 and into contact with the geological strata 11 to form a geological specimen 18 which is moved into the reactor space 36 for subsequent treatment by fluids which may be applied to the geological specimen by means of the first and second fluid passageways 91 and 92. As earlier disclosed, the first and second fluid passageways are coupled in fluid flowing relation to a location above grade 13.

Therefore, the present invention relates to an In situ reactor 10 for use in geological strata 11 which comprises a cylindrically shaped liner 20 having a main body 21 with opposite proximal and distal ends 22 and 23, an outside facing surface 24 which defines an outside diametral dimension, and an inside facing surface 25 which defines a substantially cylindrically shaped passageway 29 having a diametral dimension. This passageway 29 extends between the proximal and distal ends 22 and 23. As seen in FIG. 8, the liner 20 is placed within a borehole 15 having a diametral dimension which is greater than the outside diametral dimension of the main body 21. The borehole is formed in the geological strata 11 and extends from a location substantially at grade 13, and into the geological strata. The liner 20 is moveable along the borehole by the application of force. A geological strata engaging member 40 is borne on the distal end 23 of the cylindrically shaped liner 20. The geological strata engaging member 40 has a main body 41 with a proximal end 42 which nests within the passageway 29 at the distal end 23 of the liner 20; and a distal end 43 which engages the geological strata 11. A sampling conduit 30 is provided, and which has a substantially cylindrically shaped main body 31 with opposite proximal and distal ends 32 and 33, respectively. Still further, the sampling conduit 30 has an outside facing surface 34 which defines an outside diametral dimension and which is less than diametral dimension of the passageway 29 defined by the liner 20. Still further, the sampling conduit 30 has an inside facing surface 35 which defines a reactor space 36 which extends between the proximal and distal ends 32 and 33 of the main body 31. As seen in the drawings, an aperture 37 is formed in the main body 31 at a location near the distal end 33 and which establishes fluid flowing communication between the passageway 29 defined by the liner 20 and the reactor space 36. The main body 31 is substantially concentrically located within the passageway 29 defined by liner 20. The distal end 33 of the main body 31 is juxtaposed relative to the proximal end 42 of the geological strata engaging member 40.

A fluid coupler 70 is provided and is releasably threadably mounted on the proximal end 22 of the liner 20 and which sealably mates to the proximal end 32 of the sampling conduit 30. The fluid coupler 70 defines a first fluid passageway 91 which is coupled in fluid flowing relation relative to the passageway 29 defined by the liner 20; and a second fluid passageway 92 which is coupled in fluid flowing relation relative to the reactor space 36. The first and second fluid passageways 91 and 92 are individually coupled by way of conduits 95 to a location at or above grade 13. A force application assembly 96 is provided and which applies force to the fluid coupler 70 by way of a push rod or other member 97 to urge the liner 20, and the sampling conduit 30 to simultaneously move along the borehole 15 and into contact with the geological strata 11. As earlier discussed, the continued application of force by way of the force application assembly 96 causes a geological specimen 18, which is derived from the geological strata 11 to move into the reactor space 36 where it may thereafter be subsequently treated by various fluids which are applied by way of the first and second fluid passageways to achieve various experimental purposes.

Therefore it will be seen that the In situ reactor 10 of the present invention provides a convenient and cost effective means by which the shortcomings of the prior art devices or assemblies can be readily rectified, and which further provides an In situ reactor which may provide accurate experimental data regarding appropriate measures to be taken with respect to soil and water contamination at a given sight without the costs inherent in the prior art practices.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An in situ reactor for use in a geological strata, comprising:

a liner defining a centrally disposed passageway and which is placed in a borehole formed in the geological strata; and a sampling conduit received within the passageway defined by the liner and which receives a geological specimen which is derived from the geological strata, and wherein the sampling conduit is in fluid communication with the passageway defined by the liner, and wherein the liner is defined by a substantially cylindrically shaped main body which has a proximal end and an opposite distal end, and wherein the sampling conduit has a main body with a proximal and an opposite distal end, and wherein the main body of the sampling conduit has a length dimension which is less than the length dimension of the liner, and wherein a plurality of apertures are formed in the main body of the sampling conduit near the distal end thereof and which facilitate fluid flowing communication between the sampling conduit and the passageway defined by the liner.

2. An in situ reactor as claimed in claim 1, and further comprising:

a fluid coupler borne by the liner and which is disposed in fluid flowing communication with both the liner and the sampling conduit.

3. An in situ reactor as claimed in claim 2, and wherein the fluid coupler has a main body which defines a cavity, and which further releasably mates with the liner, and wherein the main body of the fluid coupler has a first fluid passageway formed therein, and which is disposed in fluid communication with the liner, and a second fluid passageway which communicates with the sampling conduit.

4. An in situ reactor as claimed in claim 2, and wherein the fluid coupler substantially sealably mates to each of the liner, and the sampling conduit, and wherein force is applied to the fluid coupler to urge the liner and the sampling conduit to move in unison along the borehole.

5. An in situ reactor as claimed in claim 2, and wherein the geological strata has a grade, and wherein a force is applied to the fluid coupler from a location above grade to cause the liner and the sampling conduit to move along the borehole, and wherein the liner and the sampling conduit are individually coupled in fluid flowing relation relative to a location above grade.

6. An in situ reactor as claimed in claim 5, and wherein the force applied from above grade is substantially linear.

7. An in situ reactor as claimed in claim 5, and wherein the force applied from above grade is rotational.

8. An in situ reactor as claimed in claim 5, and wherein the force applied from above grade can include both linear and rotational components.

9. An in situ reactor for use in a geological strata, comprising:

a liner defining a centrally disposed passageway and which is placed in a borehole formed in the geological strata;

a sampling conduit received within the passageway defined by the liner and which receives a geological specimen which is derived from the geological strata, and wherein the sampling conduit is in fluid communication with the passageway defined by the liner; and a fluid coupler borne by the liner and which is disposed in fluid flowing communication with both the liner and the sampling conduit, and wherein the geological strata has a grade, and wherein a force is applied to the fluid coupler from a location above grade to cause the liner and the sampling conduit to move along the borehole, and wherein the liner and the sampling conduit are individually coupled in fluid flowing relation relative to a location above grade, and wherein the force applied from above grade can include both linear and/or rotational components, and wherein a fluid is introduced into the liner from the location above grade, and wherein a fluid is withdrawn from the sampling conduit from a position above grade.

10. An in situ reactor as claimed in claim 9, and wherein the liner and the sampling conduit substantially move in unison along the borehole to receive the geological specimen, and wherein the geological specimen remains in hydraulic contact with the surrounding geological strata.

11. An in situ reactor as claimed in claim 9, and wherein the sampling conduit has a proximal and a distal end, and wherein the fluid coupler sealably mates to both the liner and the proximal end of the sampling conduit, and wherein an aperture is formed in the sampling conduit near the distal end thereof and which provides fluid flowing communication between the sampling conduit and the passageway defined by the liner, and wherein the fluid coupler includes first and second passageways which respectively communicate with the passageway defined by the liner, and the sampling conduit, and wherein the first and second passageways are coupled in fluid flowing relation to a location above grade.

12. An in situ reactor as claimed in claim 11, and wherein the geological specimen remains in hydraulic contact with the surrounding geological strata.

13. An in situ reactor as claimed in claim 12, and wherein the liner and the sampling conduit move in unison along the borehole by the application of a force which is applied to the fluid coupler from a location above grade.

14. An in situ reactor for use in geological strata, comprising:

a liner having a main body and which defines a passageway, and which has a proximal end an opposite distal end, and wherein the liner is placed within a borehole which extends from a location at grade into the geological strata, and wherein the liner is moveable along the borehole;

a sampling conduit received within the passageway, and which has a main body with a proximal and a distal end, and wherein the sampling conduit defines a reactor space which is operable to receive a geological specimen which is derived from the geological strata, and wherein an aperture is formed in the main body of the sampling conduit and near the distal end thereof, and which facilitates the fluid communication between the passageway defined by the liner, and the reactor space;

a geological strata engaging member having a main body with a proximal end which mates with the distal end of the liner, and a distal end which has a tapered shape, and wherein the main body defines a passageway which communicates with the reactor space;

a fluid coupler borne by the liner, and which is disposed in fluid communication with the passageway defined by the liner, and the reactor space, and wherein the fluid coupler is releasably sealable coupled to the proximal end of the sampling conduit, and wherein the proximal end of the geological strata engaging member is juxtaposed relative to the distal end of the sampling conduit, and wherein a source of a first fluid is supplied from a location above grade to the fluid coupler for delivery to the passageway defined by the liner, and wherein a second fluid is withdrawn from the reactor space for delivery to a location above grade, and wherein a force applied from a location above grade is applied to the fluid coupler to simultaneously urge the liner and the sampling conduit along the borehole and into contact with the geological strata, and wherein continued force applied to the fluid coupler causes the geological specimen which is derived from the geological strata to move into the reactor space.

15. An in situ reactor as claimed in claim 14, and wherein the first source of fluid is delivered to the passageway defined by the liner at the proximal end thereof, and wherein the second source of fluid is withdrawn from the reactor space at the proximal end of the sampling conduit.

16. An in situ reactor for use in geological strata, comprising:

a cylindrically shaped liner having a main body with opposite proximal and distal ends, an outside facing surface which defines an outside diametral dimension, and an inside facing surface which defines a substantially cylindrically shaped passageway having a diametral dimension, and which extends between the proximal and distal ends, and wherein the liner is placed within a borehole having a diametral dimension which is greater than the outside diametral dimension of the main body, and which is formed in the geological strata and which extends from a location substantially at grade, and into the geological strata, and wherein the liner is moveable along the borehole;

a geological strata engaging member borne on the distal end of the cylindrically shaped liner, and wherein the geological strata engaging member has a main body with a proximal end which nests within the passageway at the distal end of the liner, and a distal end which engages the geological strata;

a sampling conduit having a substantially cylindrically shaped main body with opposite proximal and distal ends, and an outside facing surface which defines an outside diametral dimension and which is less than diametral dimension of the passageway defined by the liner, and an inside facing surface which defines a reactor space which extends between the proximal and distal ends of the main body of the sampling conduit, and wherein an aperture is formed in the main body at a location near the distal end of the main body and which establishes fluid flowing communication between the passageway defined by the liner and the reactor space, and wherein the main body is substantially concentrically located within the passageway defined by liner, and wherein the distal end of the main body is juxtaposed relative to the proximal end of the geological strata engaging member;

a fluid coupler mounted on the proximal end of the liner and which sealably mates to the proximal end of the sampling conduit, and wherein the fluid coupler defines a first fluid passageway which is coupled in fluid flowing relation relative to the passageway defined by the liner, and a second fluid passageway which is coupled in fluid flowing relation relative to the reactor space, and wherein the first and second fluid passageways are individually coupled in fluid flowing relation relative to a location above grade; and a force application assembly mounted on the fluid coupler and which applies force to the fluid coupler to urge the liner and the sampling conduit to simultaneously move along the borehole and into contact with the geological strata, and wherein the continued application of force causes a geological specimen which is derived from the geological strata to move into the reactor space.

* * * * *